United States Patent [19]

Goings

[11] 3,938,474

[45] Feb. 17, 1976

[54] DISPENSER FOR COLLAPSIBLE TUBES

[76] Inventor: Harford E. Goings, P.O. Box 64, Manassas, Va. 22110

[22] Filed: Dec. 13, 1974

[21] Appl. No.: 532,585

[52] U.S. Cl. ..... 222/102
[51] Int. Cl.[2] ..... B65D 35/28
[58] Field of Search ..... 222/102, 103, 101

[56] References Cited

UNITED STATES PATENTS

| | | | |
|---|---|---|---|
| 1,700,364 | 1/1929 | Bishop | 222/102 |
| 1,793,787 | 2/1931 | Ertola | 222/102 |
| 2,530,327 | 11/1950 | Derrick | 222/102 |
| 2,679,951 | 6/1954 | Yantzer | 222/102 X |
| 3,747,806 | 7/1973 | Goings | 222/102 |

*Primary Examiner*—Robert B. Reeves
*Assistant Examiner*—Frederick R. Handren
*Attorney, Agent, or Firm*—Blair & Brown

[57] ABSTRACT

A dispenser for collapsible tubes which includes an elongate flexible plastic support for the collapsible tube having a flange on its lower end with an aperture through which the dispensing end of the tube extends. The flexible member has rows of generally rectangular apertures formed adjacent the opposite side edges thereof to serve as racks. A pair of tube squeezing rollers are journalled in a frame and are adapted to engage over the flexible member with the tube mounted thereon. One of the tube squeezing rollers has sprocket gears on each end thereof for engaging in the rack of the flexible member with the other roller having an annular groove at each end thereof into which the teeth of the first roller extend. A key on one end of the first roller is provided for rotating the rollers to move the frame downwardly on the flexible member with the rollers squeezing the front and rear of the flexible tube dispensing the contents therefrom.

1 Claim, 4 Drawing Figures

FIG. 1.
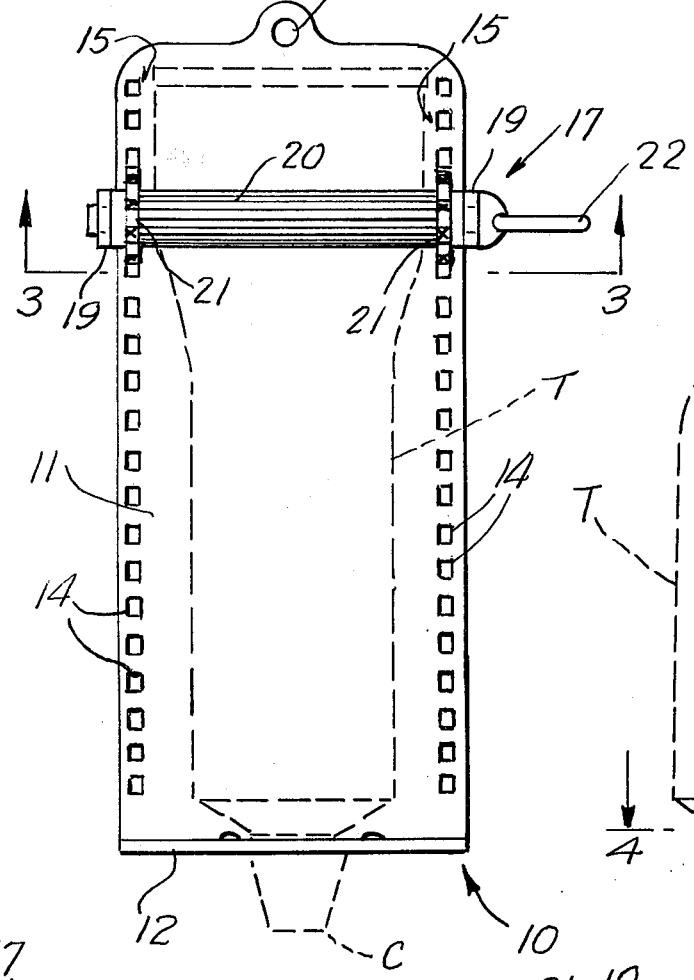
FIG. 2.
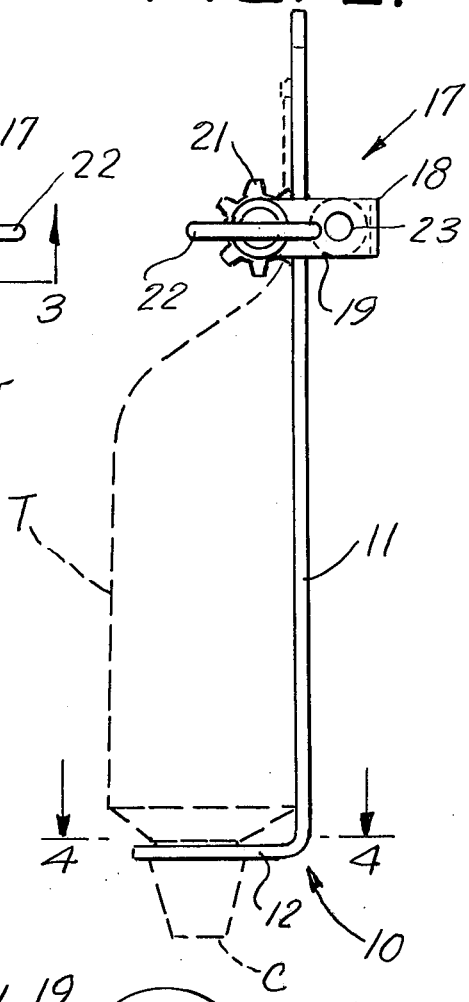
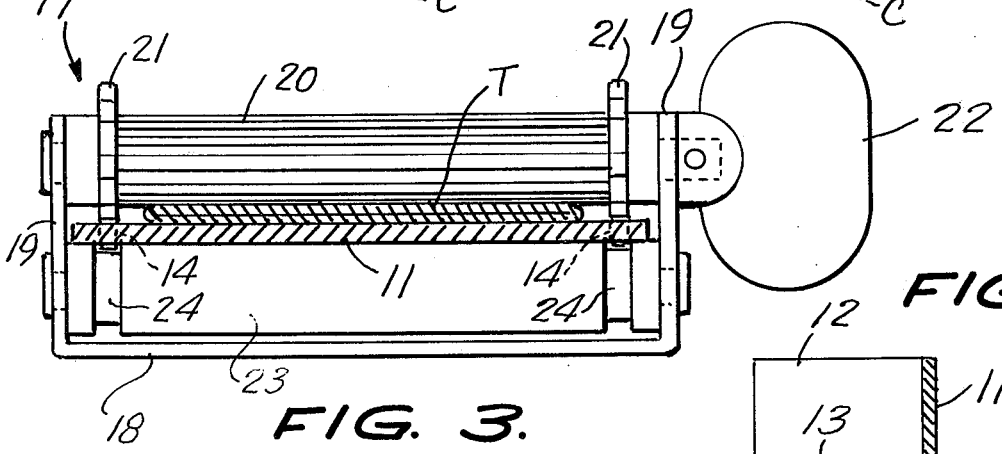
FIG. 3.
FIG. 4.
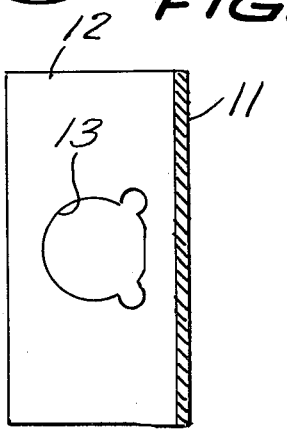

DISPENSER FOR COLLAPSIBLE TUBES

BACKGROUND OF THE INVENTION

FIELD OF THE INVENTION

The present invention relates to flexible tube dispensers of the type for forcing the contents of a flexible tube therefrom.

SUMMARY OF THE INVENTION

The flexible tube dispenser in which a gear driven pair of squeezer rollers are moved downwardly over a flexible member supporting a collapsible tube thereon with the flexible member having racks for engagement by gears on the gear driven rollers.

The primary object of the invention is to provide an inexpensive collapsible tube dispenser having forced feed for ejecting the contents of the tube therefrom.

Other objects and advantages will become apparent in the following specification when considered in light of the attached drawings.

BRIEF DESCRIPTION OF THE DRAWINGS

FIG. 1 is a front elevation of the invention;

FIG. 2 is a side elevation of the invention;

FIG. 3 is an enlarged transverse cross section taken along the line 3—3 of FIG. 1, looking in the direction of the arrows; and FIG. 4 is a transverse cross section taken along the line 4—4 of FIG. 2, looking in the direction of the arrows.

DESCRIPTION OF THE PREFERRED EMBODIMENT

Referring now to the drawings in detail, wherein like reference characters indicate like parts throughout the several figures, the reference numeral 10 indicates generally a collapsible tube dispenser unit constructed in accordance with the invention.

The unit 10 includes an elongate flexible member 11 having a flange 12 integrally formed on the lower end thereof having an aperture 13 formed therein to permit the neck of a collapsible tube T to extend therethrough. The cap C of the collapsible tube T can be applied to the tube T with the tube T supported in the unit 10.

A plurality of generally rectangular apertures 14 are arranged along opposite side edges of the flexible member 11 in evenly spaced rows forming racks generally indicated at 15 along opposite side edges of the flexible member 11. The flexible member 11 has an aperture 16 in the upper portion thereof to permit the unit to be hung on a wall hook.

A squeezer member generally indicated at 17 includes a generally U-shaped frame 18 with spaced parallel arms 19 integrally formed thereon. A roller 20 is journalled in the arms 19 at its opposite ends and has spur gears 21 mounted thereon and adapted to engage in the racks 15 of the flexible member 11. A winding key 22 is secured to the roller 20 to permit the roller 20 to be rotated by hand.

A second roller 23 is journalled in the arms 19 at its opposite ends and is arranged in spaced apart parallel relation to the roller 20 as can be seen in FIG. 3. The roller 23 has a pair of annular grooves 24 adjacent the opposite ends thereof aligned with the spur gears 21 so that the spur gear 21 can project through the rack apertures 14 in the flexible member 11 extending into the grooves 24 as can be seen in FIG. 3.

In the use and operation of the invention a tube T is mounted on the unit 10 with its neck extending through the aperture 13 and with the cap C engaging the neck to close the tube T. The squeezer member 17 is then engaged over the flexible member 11 and the upper end of the tube T with the spur gears 21 engaging in the rack apertures 14. The roller 23 is positioned on one side of the flexible member 11 while the roller 20 is engaged against the tube T on the other side of the flexible member 11. Rotation of the key 22 rotates the roller 20 and causes the roller 20 to move downwardly with respect to the tube T so as to dispense the contents from the tube T when the cap C is removed. After a suitable quantity of the contents of the tube T have been dispensed the rollers 20, 23 are moved upwardly slightly to relieve the pressure on the tube T and the cap C is replaced.

Having thus described the preferred embodiment of the invention it should be understood that numerous structural modifications and adaptations may be resorted to without departing from the spirit of the invention.

What is claimed is:

1. A collapsible tube dispenser comprising an elongate flexible plastic member for supporting a collapsible tube thereon, a frame, a plurality of rack forming apertures formed in a row down each of the opposite side edges of said flexible member, a pair of squeeze rollers journalled in said frame for engaging over the flexible member with the collapsible tube positioned thereagainst for squeezing the collapsible tube against the flexible member, hand rotatable spur gears rigidly mounted on one of said squeeze rollers for rotating said rollers to move said frame as said spur gears engage the rack apertures, a hand key rigidly secured to the roller carrying said spur gears, and annular grooves adjacent opposite ends of the second of said rollers with the spur gears on the other of said rollers engaging in said annular grooves.

* * * * *